United States Patent [19]

Marbach

[11] Patent Number: 4,627,580

[45] Date of Patent: Dec. 9, 1986

[54] APPARATUS FOR SEVERING FOAMED MATERIAL

[75] Inventor: Karl G. Marbach, Weinsberg, Fed. Rep. of Germany

[73] Assignee: Karl G. Marbach GmbH & Co., Heilbronn, Fed. Rep. of Germany

[21] Appl. No.: 657,006

[22] Filed: Oct. 2, 1984

[30] Foreign Application Priority Data

Oct. 7, 1983 [DE] Fed. Rep. of Germany ..... 3336562

[51] Int. Cl.[4] ..... B02C 18/06; B02C 19/12

[52] U.S. Cl. ..... 241/101.4; 241/223; 241/242

[58] Field of Search ..... 241/152 R, 60, 3, 101.4, 241/101.2, 223, 239, 241, 242, 235, 55

[56] References Cited

U.S. PATENT DOCUMENTS

| | | | |
|---|---|---|---|
| 1,218,096 | 3/1917 | Lindsey | 241/101.4 |
| 1,936,173 | 11/1933 | Orth | 241/223 X |
| 2,735,469 | 2/1956 | West | 241/55 |
| 3,217,988 | 11/1965 | Lightfoot et al. | 241/101.4 X |

FOREIGN PATENT DOCUMENTS

| | | |
|---|---|---|
| 2602706 | 2/1977 | Fed. Rep. of Germany . |
| 2624192 | 8/1979 | Fed. Rep. of Germany . |
| 826103 | 12/1959 | United Kingdom . |

*Primary Examiner*—Mark Rosenbaum

*Attorney, Agent, or Firm*—Peter K. Kontler

[57] ABSTRACT

Apparatus for converting blocks of foamed synthetic plastic material into chips has a severing device which removes from a block a continuous layer or a series of discrete layers of foamed material, a severing device with a series of coaxial rotary disc-shaped knives which subdivide each layer into a plurality of parallel elongated strips, and a severing device which converts the strips into discrete chips. Each chip has a substantially rhomboidal cross-sectional outline. The chip forming severing device has a shaft which is parallel to the shaft that carries the disc-shaped knives of the device that converts the layer or layers into strips, and the shaft of the chip forming severing device carries one or more cutters with straight or helical edges. The unit which advances the layer or layers past the disc-shaped knives of the strip forming severing device has several endless belt conveyors which advance the strips all the way into the range of the chip forming severing device.

26 Claims, 3 Drawing Figures

APPARATUS FOR SEVERING FOAMED MATERIAL

BACKGROUND OF THE INVENTION

The present invention relates to comminuting apparatus in general, and more particularly to improvements in apparatus for severing foamed materials. Still more particularly, the invention relates to improvements in apparatus for converting large or very large blocks or layers of foamed material into strips and fragments of strips.

German Auslegeschrift No. 26 24 192 discloses a comminuting apparatus which can convert a layer of foamed synthetic plastic material into a plurality of parallel elongated strips. The apparatus comprises a driven shaft carrying a plurality of axially spaced-apart rotary disc-shaped knives which penetrate into successive increments of a layer of foamed plastic material that is being moved transversely of the shaft. The means for advancing the layer past the severing station for the aforementioned shaft and its disc-shaped knives preferably comprises a plurality of endless belt conveyors which are trained around at least two pulleys so that each such conveyor has an elongated reach or stretch that contacts one side of the layer and entrains it past the severing station. The width of each strip corresponds to the distance between two neighboring disc-shaped knives on the shaft.

British Pat. No. 826 103 discloses an apparatus which is designed to peel layers of foamed plastic material from a block. The means for transporting the layers which are removed from the block also comprises endless belt conveyors which are spaced apart from each other and are disposed in parallel planes. The means for peeling layers off the block comprises a knife which is guided in a splitting wedge.

German Auslegeschrift No. 26 02 706 discloses relatively small rod-shaped bodies or chips which are made of soft foamed synthetic plastic material and have a substantially rhomboidal cross-sectional outline. Such chips are frequently used as a material for filling pillows, cushions and similar receptacles. The specific configuration of the chips (namely so that their cross sections resemble parallelegrams or rhombi) enables the chips to act not unlike down. As a rule, the chips have a length of approximately 30 mm, a width of 8 mm and a height of 3 mm.

OBJECTS AND SUMMARY OF THE INVENTION

An object of the invention is to provide a novel and improved apparatus which can convert blocks, layers and/or strips of foamed synthetic plastic or other material into chips of desired size and shape in a simple, time-saving and efficient manner.

Another object of the invention is to provide a novel and improved apparatus which can make chips from larger bodies consisting of soft foamed synthetic plastic material, such as polyether.

A further object of the invention is to provide the apparatus with novel and improved means for converting strips of foamed material into discrete chips of desired cross-sectional outline.

An additional object of the invention is to provide a novel and improved method of converting cylindrical or parallelepiped blocks of foamed material into chips.

A further object of the invention is to provide the above-outlined apparatus with novel and improved means for guiding and advancing layers and/or strips of foamed material into the range of instrumentalities at the chip forming station.

A further object of the invention is to provide the apparatus with novel and improved means for ensuring that the formation of chips will take place with the generation of minimal noise or with practically no noise at all as well as that the formation of chips does not involve the application of pronounced stresses to the constituents of the improved apparatus.

Another object of the invention is to provide an apparatus which can make chips from a wide variety of foamed synthetic plastic and other materials, which can be readily converted for the making of longer or shorter chips, which can convert a continuous layer or successive discrete layers of foamed material into strips of desired width, and which can automatically gather and evacuate the chips in a predictable and efficient manner.

An additional object of the invention is to provide the apparatus with novel and improved chip forming means which simultaneously constitutes a component of means for evacuating chips from the respective severing station.

The invention resides in the provision of an apparatus for comminuting a layer of foamed material. The apparatus comprises means for advancing the layer in a predetermined direction along a predetermined path (such path can but need not always be a horizontal path), a first severing device which is adjacent to a first portion of the path and includes a plurality of tools which serve to subdivide the layer into elongated strips which move along the path lengthwise beyond the first portion of the path, and a second severing device which is adjacent to a second portion of the path, as considered in the aforementioned direction, and serves to repeatedly sever the oncoming strips transversely of the aforementioned direction so that each strip yields a succession of discrete chips or fragments. The first severing device preferably includes a driven shaft which extends transversely of the path, and the tools preferably include spaced-apart rotary disc-shaped knives on the shaft. The advancing means preferably comprises a plurality of endless flexible conveyors which are disposed in planes extending in parallelism with the aforementioned direction and being normal to the path. Such conveyors include elongated reaches which extend between the path and the shaft of the first severing device intermediate the disc-shaped knives and engage and entrain the layer in the aforementioned direction. The reaches of the endless flexible conveyor preferably extend past and beyond the first portion of the path so that they can entrain the strips into the range of the second severing device. The second severing device preferably includes at least one cutter which is mounted for orbital movement about an axis that is at least substantially parallel to the axis of the shaft forming part of the first severing device. Such cutter has at least one cutting edge which severs the strips in a plane preferably making an oblique angle with the path.

The apparatus preferably further comprises guide means for the layer, and such guide means is adjacent to one side of the path opposite the first severing device which latter is adjacent to the other side of the path. The guide means is preferably provided with a counterknife which is adjacent to the second portion of the path and cooperates with the second severing device to sever the strips. The guide means is preferably further formed with an elongated and preferably smooth layer-contacting surface which terminates at the counterknife. The cutter or cutters of the second severing device are preferably mounted on and orbit about the axis of a second shaft which is parallel with the shaft of the first severing device. The axes of the two shafts are located in a plane which is disposed at a level above the counterknife of the guide means. Such orientation of the aforementioned plane relative to the counterknife and hence relative to the location where the counterknife cooperates with the cutting edge or edges of the cutter or cutters of the second severing device ensures that the strips are subdivided into chips which have pairs of parallel surfaces and at least one pair of additional parallel surfaces which make an obtuse or acute angle with the first mentioned parallel surfaces.

The second severing device can comprise at least one substantially chisel-shaped cutter and means for separably securing such cutter to the respective shaft so that the cutting edge of the cutter orbits about the axis of the associated shaft. Alternatively, the second severing device can comprise a cutter having a substantially helical cutting edge and being secured to the respective shaft so that the cutting edge orbits about the axis of the shaft. Such construction contributes to quieter operation of the apparatus because all of the strips are not severed simultaneously. The cutter or cutters of the second severing device can be mounted on one or more air-circulating vanes which connect the shaft of the second severing device with such cutter or cutters. The purpose of the vane or vanes is to circulate air and to thereby propel the chips in a particular direction. For example, each cutter can be made integral with the corresponding vane; such vane preferably extends substantially radially of the respective shaft and the cutter or cutters extend from the vane or vanes in the circumferential direction of the respective shaft. An enclosure can be provided for the second severing device and for the chips. Such enclosure is preferably provided with means for evacuating the chips from its interior. For example, the evacuating means can include a funnel-shaped portion which tapers in a direction away from the second severing device and an outlet which is provided in the funnel-shaped portion and is remote from the second severing device.

In accordance with a presently preferred embodiment, the endless flexible conveyors of the advancing means are preferably trained about three elongated pulleys which are parallel with the shaft of the first severing device. Such pulleys preferably include a smaller-diameter pulley which is close or immediately or adjacent to the second portion of the path. The smaller-diameter pulley is disposed at one side of the path opposite and closely adjacent to the aforementioned counterknife which is disposed at the other side of the path, and, as explained above, cooperates with the cutter or cutters of the second severing device to subdivide the strips into discrete chips.

The apparatus of the present invention can be utilized for comminuting of layers which are obtained in response to the splitting of a block of foamed material. Such apparatus then preferably further comprises a third severing device which serves to sever a continuous layer or several discrete layers from the block and means for effecting a relative movement between the block and the third severing device so that the latter can remove from the block a continuous layer or several successive layers until the block is consumed. If the block is a cylinder, the means for effecting a relative movement preferably includes means for rotating the cylinder so that the third severing device peels a continuous layer off the rotating cylindrical block. The third severing device preferably includes the aforementioned guide means, which can constitute a substantially wedge-shaped member disposed at one side of the path, and a knife which is adjacent to the guide means at the one side of the path. The first severing device is disposed at the other side of the path opposite the wedge-shaped guide means and the knife of the third severing device. The endless flexible conveyors of the advancing means are also adjacent to the second side of the path. As mentioned before, the guide means has a preferably smooth surface, is contacted by the layer and also by the strips at the one side of the path. The reaches of the endless flexible conveyors are preferably parallel to the surface of the wedge-shaped guide means. Such guide means is provided with an edge which extends transversely of the path, and the knife of the third severing device preferably includes an endless saw-like flexible element having an elongated stretch which is adjacent to or constitutes the edge of the wedge-shaped guide means.

The apparatus can further comprise a common support for the first, second and third severing devices, and the means for effecting a relative movement can include means for moving the support relative to the block. Such moving means can include means for moving the support between a plurality of neighboring levels, and the distance between two neighboring levels preferably at least approximate the thickness of a layer. If the block is a cylinder, the apparatus further comprises the aforementioned means for rotating the block about its axis and means for shifting the block relative to the support and at least substantially transversely of the axis of the block. Such movements of the means for rotating the block and/or the support ensure that the third severing device can peel a continuous layer from the rotating block.

The support can include two spaced-apart sidewalls and the severing devices are then disposed between the two sidewalls. The shafts of the first and second severing devices, the pulley or pulleys of the advancing means, and the mobile component or components of the third severing device are or can be journalled in the two sidewalls or the support. The drive means for the shafts, pulleys and/or mobile component or components can be mounted on the one and/or the other sidewall of the support.

That surface of the guide means which faces the path for the layer is preferably provided with recesses to receive portions of the tools which are mounted on the shaft of the first severing device and serve to subdivide the layer or layers into a substantial number of elongated parallel strips. If the tools are rotary disc-shaped knives, portions of such knives extend all the way through the layer or layers on the surface of the guide means and into the respective recesses of the guide means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
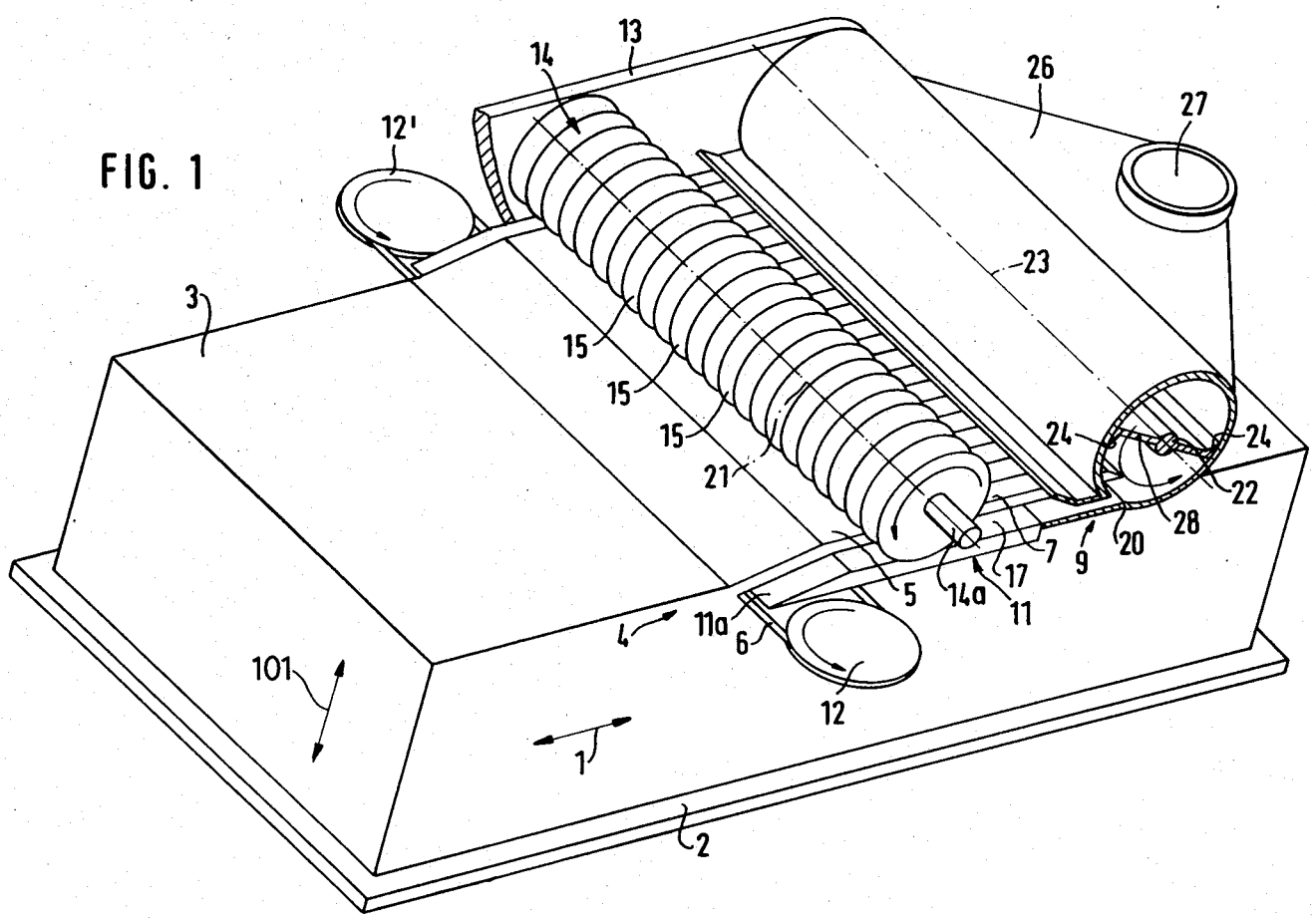
FIG. 1 is a fragmentary perspective partly sectional view of an apparatus which embodies one form of the invention and wherein the third severing device is designed to remove a succession of discrete layers from a parallelepiped block of foamed synthetic plastic material.
Figure 3:
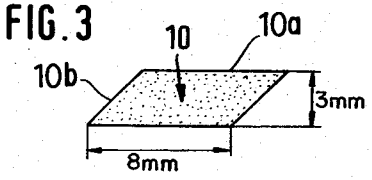
FIG. 3 is an enlarged end elevational view of a chip.
Figure 2:
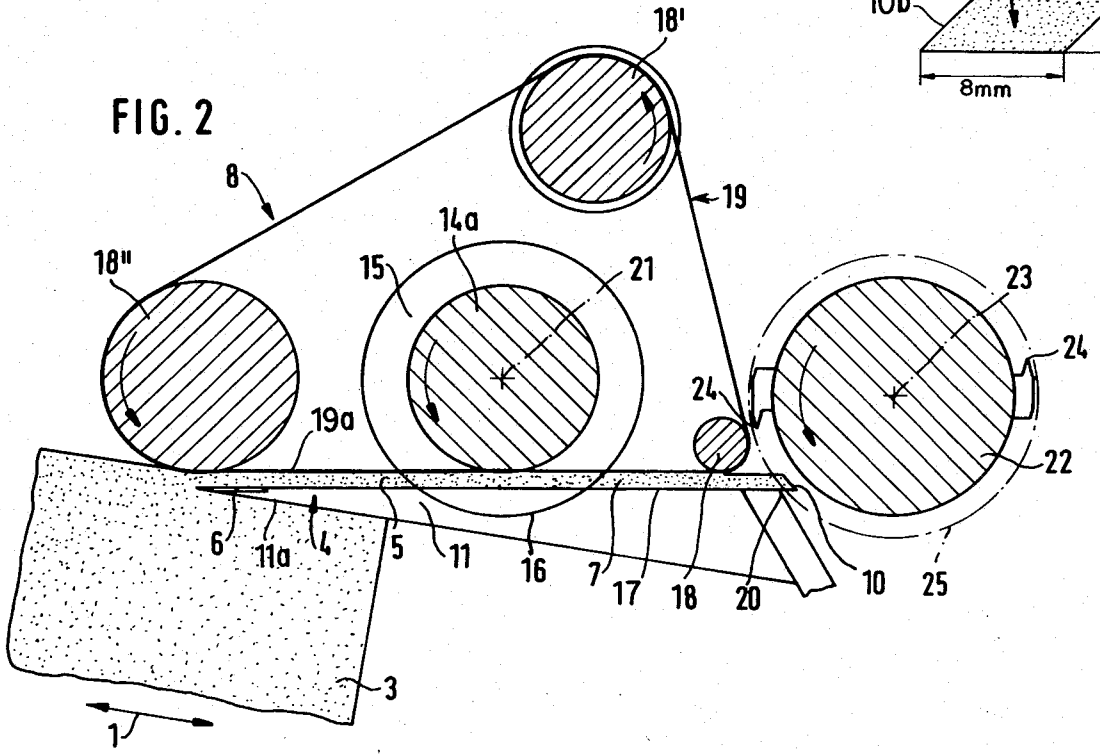
FIG. 2 is an enlarged longitudinal vertical sectional view of a portion of the block, of the first severing device which converts successive layers into strips, of the second severing device which converts the strips into chips, and of the third severing device which removes successive layers from the block.

Referring first to FIG. 1, there is shown a portion of an apparatus which serves to convert a block or slab 3 of foamed synthetic plastic material into a plurality of chips or fragments 10 of the type shown in FIG. 3. The block 3 is supported by a platform or table 2 which is reciprocable in directions indicated by a double-headed arrow 1. The reference character 4 denotes a severing device which serves to convert the block 3 into a series of discrete layers 5, and each such layer is thereupon subdivided into a plurality of elongated parallel strips 7 by a severing device 14. An additional severing or chip forming device 9 is provided to convert the strips 7 into chips 10. The severing device 4 comprises an endless knife 6 which is trained over a pair of wheels 12 and 12' in front of the leading edge 11*a* of a wedge-like guide 11. The guide 11 and the knife 6 of the severing device 4 are located at one side of (namely below) the path of movement of the layer 5 under the action of a transporting or advancing device 8 the details of which are shown in FIG. 2. The formation of layers 7 is effected by the elongated front stretch of the endless knife 6 which is adjacent to the edge 11*a* of the guide 11 and extends transversely of the direction of movement of the layer 5 past the severing station which accommodates the device 14 for conversion of a layer into strips 7. The rear stretch or reach of the knife 6 is located at a level below the wedge-shaped guide 11 and does not perform any severing action. The wheels 12 and 12', and more particularly their vertical shafts (not shown), are mounted in a support including two elongated parallel sidewalls 13 of which one is shown in FIG. 1. The lateral end portions of the guide 11 are also mounted on the sidewalls 13.

The severing device 14 which converts the layer 5 into strips 7 comprises an elongated horizontal shaft 14*a* the end portions of which are mounted in the sidewalls 13 and which carries a plurality of disc-shaped severing tools 15. The mutual spacing of neighboring tools 15 equals the width of the strips 7 and the length of the chips 10. Such mutual spacing can be altered if it is desired to convert the layer 5 into wider or narrower strips. The lowermost portions of the rotating tools 15 extend downwardly beyond the path of the layer 5 and into suitably configurated complementary recesses 16 which are machined into the flat and smooth elongated top surface 17 of the guide 11. The shaft 14*a* of the severing device 14 extends transversely of the direction of movement of the layer 5 and strips 7 and is adjacent to the upper side of the path for the layer.

The advancing unit 8 for the layer 5 and strips 7 comprises a plurality of endless flexible belt conveyors 19 each of which is trained about three elongated roller-shaped pulleys 18, 18', 18''. The lower stretches or reaches 19*a* of the belt conveyors 19 engage the upper sides of the layer 5 and strips 7 and advance such parts in a direction to the right, as viewed in FIG. 2, into the range of orbiting cutters 24 forming part of the severing device 9. The undersides of the reaches 19*a* engage the upper side of the layer 5 and the upper sides of the respective strips 7 opposite the top surface 17 of the guide 11. Such lower reaches 19*a* are preferably parallel to the surface 17.

If desired, the construction of the advancing unit 8 can be simplified by omitting the pulleys 18' and 18'' and by training each of the endless flexible belt conveyors 19 only around the smallest-diameter pulley 18 and the shaft 14*a* of the severing device 14 between pairs of neighboring disc-shaped severing tools 15.

The surface 17 of the guide 11 extends not only along the underside of that portion of the path for the layer 5 and strips 7 where the layer is converted into strips by the tools 15 but also all the way to that portion of the path where the leaders of the strips 7 are converted into chips 10. At such location, the guide 11 defines a counterknife 20 which cooperates with the cutting edges of the cutters 24 of the severing or chip forming device 9 to convert the strips 7 into chips 10. The counterknife 20 extends transversely of the path for the layer 5 and strips 7 and is parallel to the axis 21 of the shaft 14*a* as well as to the axis 23 of a shaft 22 which carries the cutters 24. The end portions of the shafts 14*a*, 22 and of the pulleys 18, 18', 18'' are rotatably journalled in the sidewalls 13 of the support for the three severing devices of the improved apparatus. In the illustrated embodiment, the shaft 22 of the severing device 9 carries two cutters 24 which are disposed diametrically opposite each other and each of which is mounted at the outer end of a radially extending air-circulating vane 28 secured to the shaft 22. The path of orbital movement of the cutting edges of the cutters 24 is indicated by the phantom-line circle 25. A portion of this path 25 is adjacent to the counterknife 20. The axis 23 of the shaft 22 is located at a level above the surface 17 of the guide 11 in such position that the counterknife 20 cooperates with the cutting edges of the cutters 24 to form substantially rhomboidal chips 10. This can be readily seen in FIG. 2 which shows that the portion of the path 25 is adjacent to the counterknife 20 makes with the path for the strips 7 an oblique angle equal to or approximating 45°. Each of the chips 10 preferably resembles a relatively short rod of substantially rhomboidal cross-sectional outline. As shown in FIG. 3, the width of each rod can be approximately 8 mm, its height can be approximately 3 mm, and (this is not shown in FIG. 3) its length can be approximately 30 mm. The length of the chips 10 (as considered at right angles to the plane of FIG. 3) is determined by the mutual spacing of neighboring tools 15 on the shaft 14*a* of the severing device 14. The configuration of the chips 10 and their dimensions are preferably such as disclosed in German Auslegeschrift No. 26 02 706. As mentioned above, such chips can be used as fillers for pillows, padded blankets, cushions and the like.

Referring again to FIG. 1, the severing device 9 is preferably surrounded by an enclosure 26 which facilitates orderly evacuation of chips 10 and thus contributes to higher output of the apparatus. The enclosure 26 comprises a portion which tapers in a direction away from the path of orbital movement of the cutters 24 and resembles a funnel having an outlet 27 which can be connected to a suction generating device for predictable evacuation of chips 10 from the interior of the enclosure 26. Furthermore, the vanes 28 on which the cutters 24 are mounted serve to circulate air in the interior of the enclosure 26 in such a way that they promote the progress of chips 10 toward and through the outlet 27. The exact nature of the suction generating device which can be connected to the outlet 27 of the enclosure 26 forms no part of the present invention. The outlet 27 is disposed at that end of the funnel-shaped portion of the enclosure 26 which is remote from the severing device 9.

The support which includes the sidewalls 13 and supports the shafts of the wheels 12, 12', the shaft **14*a*, the guide 11, the pulleys 18, 18', 18'' of the advancing unit 8 and the shaft 22 of the severing device 9 preferably constitutes a compact unit which is movable between a plurality of different levels in directions indicated by a double-headed arrow 101. This enables the cutting reach or stretch of the knife 6 to sever consecutive layers 5 of predetermined thickness from the upper portion of the reciprocating block 3. The arrangement is such that the support including the sidewalls 13 descends by a step (the height of which preferably equals or closely approximates the thickness of a layer 5) after the platform 2 for the block 3 completes a combined forward and a return stroke. The means for reciprocating the platform 2 can comprise an eccentric drive, a double-acting fluid-operated cylinder and piston assembly, a rack and pinion drive or any other suitable motion transmitting means. The same applies for the means for moving the support including the sidewalls 13 in the directions which are indicated by the double-headed arrow 101**.

It is clear that the means for reciprocating the support including the sidewalls 13 in the directions which are indicated by the arrow 101 can be omitted if the platform 2 is connected with means which not only move such platform and the block 3 thereon in the directions indicated by the arrow 1 but also in the directions indicated by the arrow 101. The means for moving the support relative to the platform 2 and/or vice versa is preferably adjustable so as to ensure that the apparatus will turn out chips 10 having desired lengths, widths and heights. The thickness or height of the chips 10 will depend upon the ratio of the speed of the endless belt conveyors 19 to the rotational speed of the shaft 22 for the cutters 24. The means for driving the various shafts, pulleys and/or other mobile components of the apparatus can be mounted on the one and/or the other sidewall 13. For example, such means can include a single electric motor or another suitable prime mover and a requisite number of suitable transmissions which transmit motion from the output element of the single prime mover to various rotary or otherwise movable parts.

An important advantage of the improved apparatus is its versatility. For example, the configuration of the chips 10 can be readily changed by altering the inclination of the surface 17 of the wedge-shaped guide 11 relative to the path 25 of orbital movement of the cutters 24 on the vanes 28 of the shaft 22.

The cutters 24 which are shown in FIG. 2 are impact-type cutters because they strike against the upper sides of strips 7 and effect a severing action in conjunction with the stationary counterknife 20. The number of cutters 24 can be reduced to one or increased to three or more without departing from the spirit of the invention. It is also possible to replace the illustrated cutters 24 with a cutter having a spiral or helical cutting edge which orbits along the path 25 and severs the strips 7 one after the other rather than simultaneously. This brings about the important advantage that the apparatus generates less noise than an apparatus with impact type cutters in the severing device 9. As mentioned above, the design of the severing device 9 is preferably such that the surfaces **10*a* and the surfaces 10*b* of the chips 10 (see FIG. 3) make an angle of approximately 45 degrees. As also mentioned before, the length of the chips 10 (as considered at right angles to the plane of FIG. 3) is determined by the distances between neighboring tools 15 on the shaft 14*a* of the severing device 14**.

In accordance with a presently preferred embodiment, the cutters of the severing device 9 resemble or constitute chisels of the type used in planes, especially jack or block planes. Means is then provided for separably securing such chisel-shaped cutters to the shaft 22 or to the respective vanes 28. In order to ensure more satisfactory balance, it is preferred to employ more than two cutters 24 and to uniformly distribute such cutters about the circumference of the shaft 22. Of course, a single cutter will suffice if it is provided with a substantially helical cutting edge extending around the shaft 22 all the way from one to the other sidewall 13. An important advantage of the cutter with a helical cutting edge is that the apparatus produces less noise. On the other hand, sharpening of a helical cutting edge is more complex than sharpening of straight cutting edges on chisels or similar cutters.

The illustrated enslosure 26 for the severing device 9 can be replaced with other types of enclosures without departing from the spirit of the invention. However, the illustrated enclosure 26 with its funnel-shaped portion and outlet 27 is preferred at this time because it is less likely to permit the accumulation of large quantities of chips in close proximity of the orbiting cutters 24 which could result in unnecessary repeated comminuting of the chips.

An advantage of the small-diameter pulley 18 in the advancing unit 8 is that such small pulley can be placed very close to the counterknife 20 (but at the opposite side of the path for the strips 7) so that the lower reaches of the endless belt conveyors 19 can guide and positively advance the strips 7 practically all the way to the location where the counterknife 20 cooperates with the cutting edges of the cutters 24 to form the chips 10.

It will be noted that the wedge-shaped guide 11 forms part of the severing device 4 for the making of layers 5 and that such guide also cooperates with the advancing unit 8 to predictably advance the layer 5 and the strips 7 toward the station which accommodates the severing device 9.

If desired, the surface 17 of the guide 11 can be provided with a plurality of ports which discharge streamlets of compressed air or another gaseous fluid. This is desirable and advantageous because the streamlets of gaseous fluid reduce friction between the underside of the layer 5 and the surface 17 as well as between the undersides of the strips 7 and the surface 17 and thereby further enhance the predictability of the transporting action of the unit 8.

It is also within the purview of the invention to replace the parallelepiped block 3 of FIG. 1 with a cylindrical block consisting of foamed synthetic plastic material. The apparatus then comprises a suitable stand in which the cylindrical block is rotatably mounted and means for moving the stand relative to the severing device 4 so that the front reach or stretch of the knife 6 can sever a continuous strip from the radially outermost portion of the cylindrical block and the diameter of the cylindrical block decreases gradually at a rate which is dependent upon the selected thickness of the continuous layer. The operation is then analogous to that which is known from the making of wood veneers or the like.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for comminuting layers which are obtained in response to slitting of a block of foamed material, comprising means for advancing the layer in a predetermined direction along a predetermined path; a first severing device adjacent to a first portion of said path and including a driven shaft extending transversely of said path and a plurality of tools arranged to subdivide each layer into elongated strips which move along said path lengthwise beyond said first portion, said tools including spaced-apart rotary disc-shaped knives on said shaft; a second severing device adjacent to a second portion of said path which is disposed downstream of said first portion, as considered in said direction, said second severing device being arranged to repeatedly sever the oncoming strips transversely of said direction so that each strip yields a succession of discrete chips, said advancing means comprising a plurality of endless flexible conveyors disposed in planes extending in parallelism with said direction and at right angles to said path, said conveyors having stretches which extend between said path and said shaft intermediate said knives along and beyond the first portion of said path to engage and entrain the strips in said direction into the range of said second severing device; a third severing device having a knife arranged to sever layers from the block; and means for effecting a relative movement between the block and said third severing device so that the latter removes layers from the block.

2. The apparatus of claim 1, wherein said third severing device includes a guide adjacent to one side of said path and said first severing device includes a driven shaft disposed at the other side of said path and supporting said tools, said tools having portions which extend beyond said one side of said path and said guide having recesses for such portions of said tools.

3. The apparatus of claim 1, wherein the block is a cylinder and said means for effecting a relative movement includes means for rotating the cylinder so that the knife peels a continuous layer therefrom.

4. The apparatus of claim 1, wherein said second severing device includes at least one cutter arranged to orbit about an axis which is at least substantially parallel to the axis of said shaft.

5. The apparatus of claim 4, wherein said cutter includes at least one cutting edge which is arranged to sever the strips in a plane making an oblique angle with said path.

6. The apparatus of claim 1, further comprising guide means for the layers, said guide means being adjacent to one side and said first severing device being adjacent to the other side of said path and said guide means having a counterknife adjacent to the second portion of said path and cooperating with said second severing device to sever the strips, said guide means further having a layer-contacting surface terminating at said counterknife.

7. The apparatus of claim 6, wherein said first and second severing devices respectively comprise parallel first and second shafts whose axes are located in a predetermined plane, said second severing device further comprising at least one cutter having at least one cutting edge arranged to orbit about said second shaft and said counterknife being disposed at one side of and being remote from said plane and adjacent to a portion of the path of orbital movement of said cutting edge.

8. The apparatus of claim 1, wherein said second severing device comprises a driven shaft, at least one substantially chisel-shaped cutter having at least one cutting edge, and means for separably securing said cutter to said shaft so that said cutting edge orbits about the axis of said shaft.

9. The apparatus of claim 1, wherein said second severing device comprises a driven shaft and at least one cutter having a substantially helical cutting edge and being secured to said shaft so that said cutting edge orbits about the axis of said shaft.

10. The apparatus of claim 1, wherein said second severing device comprises a driven shaft, at least one cutter and an air-circulating vane connecting the shaft with the cutter so that the cutter orbits about the axis of said shaft.

11. The apparatus of claim 10, wherein said cutter is integral with said vane, said vane being disposed substantially radially of said shaft and said cutter extending from said vane in the circumferential direction of said shaft.

12. The apparatus of claim 1, further comprising an enclosure for said second severing device and the chips, said enclosure having means for evacuating the chips from the interior thereof.

13. The apparatus of claim 12, wherein said evacuating means includes a funnel-shaped portion which tapers in a direction away from said second severing device and an outlet which is provided in said funnel-shaped portion and is remote from said second severing device.

14. The apparatus of claim 1, wherein said tools are spaced apart from one another, as considered in the axial direction of said shaft, said advancing means further comprising three pulleys and said conveyors being trained over said pulleys.

15. The apparatus of claim 14, wherein said pulleys include a smaller-diameter pulley whose axis is parallel to the axis of said shaft and two larger-diameter pulleys, said smaller-diameter pulley being closely adjacent to the second portion of said path.

16. The apparatus of claim 15, further comprising guide means for the layers and the strips, said guide means being adjacent to one side and said reaches being adjacent to the other side of said path, said guide means having a counterknife cooperating with said second severing device to subdivide the strips into chips and said smaller-diameter pulley being disposed at the second side of said path closely adjacent to said counterknife.

17. The apparatus of claim 1, wherein said third severing device includes a substantially wedge-shaped guide at one side of said path and said knife is adjacent to said guide at said one side of said path, said first severing device having a driven shaft for said tools, said shaft being disposed at the other side of said path and said advancing means including endless flexible conveyors having reaches engaging the layer and the strips at the other side of said path, said guide having a surface which is contacted by the layer and by the strips at said one side of said path.

18. The apparatus of claim 17, wherein said guide includes a counterknife cooperating with said second severing device to convert the strips into chips and said surface terminates at said counterknife.

19. The apparatus of claim 18, wherein said reaches are parallel to said surface.

20. The apparatus of claim 17, wherein said guide has an edge extending transversely of said path and said knife includes an endless saw-like flexible element having an elongated stretch adjacent to the edge of said guide.

21. The apparatus of claim 17, wherein said guide has an edge extending transversely of said path and said knife includes an endless saw-like flexible element having an elongated stretch constituting the edge of said guide.

22. The apparatus of claim 1, further comprising a common support for said severing devices, said means for effecting a relative movement including means for moving said support relative to the block.

23. The apparatus of claim 22, wherein said moving means includes means for moving said support between a plurality of neighboring levels and the distance between two neighboring levels at least approximates the thickness of the layer.

24. The apparatus of claim 22 for comminuting layers which are obtained in response to slitting of a cylindrical block of foamed material, further comprising means for rotating the block about its axis and for shifting the block relative to said support transversely of the axis of the block.

25. The apparatus of claim 22, wherein said support includes two spaced-apart sidewalls and said severing devices are disposed between said sidewalls, each of said first and second severing devices comprising a shaft and said advancing means including at least one pulley, said shafts and said pulley having parallel axes and being rotatably journalled in said sidewalls.

26. The apparatus of claim 25, wherein said third severing device has a mobile compenent and further comprising drive means for said shafts and said component, said drive means being mounted on at least one of said sidewalls.

* * * * *